US009381767B2

(12) United States Patent
Rahn

(10) Patent No.: US 9,381,767 B2
(45) Date of Patent: Jul. 5, 2016

(54) DEVICE FOR STORING AND APPLYING A FLUID PRODUCT

(75) Inventor: Joerg Rahn, Heroldsberg (DE)

(73) Assignee: STABILO International GmbH, Heroldsberg (DE)

( * ) Notice: Subject to any disclaimer, the term of this patent is extended or adjusted under 35 U.S.C. 154(b) by 2383 days.

(21) Appl. No.: 12/181,527

(22) Filed: Jul. 29, 2008

(65) Prior Publication Data

US 2009/0035051 A1 Feb. 5, 2009

(30) Foreign Application Priority Data

Aug. 2, 2007 (DE) ..... 20 2007 010 760 U

(51) Int. Cl.

| | |
|---|---|
| ***B43K 5/00*** | (2006.01) |
| ***B43K 8/00*** | (2006.01) |
| ***B43K 8/03*** | (2006.01) |
| ***B43K 8/08*** | (2006.01) |
| ***B43K 11/00*** | (2006.01) |
| ***B43K 23/04*** | (2006.01) |
| ***B43L 25/00*** | (2006.01) |

(52) U.S. Cl.

CPC ... *B43K 8/03* (2013.01); *B43K 8/08* (2013.01); *B43K 11/005* (2013.01); *B43K 23/04* (2013.01); *B43L 25/007* (2013.01); *B43L 25/008* (2013.01)

(58) Field of Classification Search

USPC ..... 401/131, 196, 198, 199

See application file for complete search history.

(56) References Cited

U.S. PATENT DOCUMENTS

| | | | | | |
|---|---|---|---|---|---|
| 1,356,910 | A | * | 10/1920 | Delbare | 401/198 |
| 2,620,499 | A | | 12/1952 | Dressel | |
| 2,708,904 | A | | 5/1955 | Rhoades | |
| 2,740,979 | A | * | 4/1956 | Bridy | 401/198 |
| 4,614,163 | A | | 9/1986 | Hetzer et al. | |
| 5,352,052 | A | | 10/1994 | Kaufmann | |
| 5,865,553 | A | | 2/1999 | Flye Sainte Marie et al. | |
| 6,132,123 | A | * | 10/2000 | Gueret | 401/131 |

FOREIGN PATENT DOCUMENTS

| | | | |
|---|---|---|---|
| DE | 584101 | | 9/1933 |
| DE | 1904522 | | 8/1970 |
| DE | 7230633 | | 4/1973 |
| DE | 3544328 | | 6/1987 |
| EP | 0137171 | | 4/1985 |
| EP | 0822098 | | 2/1998 |
| FR | 816149 | | 7/1937 |
| FR | 1086340 | | 2/1955 |
| JP | 55-150763 | U1 | 10/1980 |
| JP | 06-127185 | A | 5/1994 |
| JP | 2001054560 | A | 2/2001 |
| JP | 2006230230 | A | 9/2006 |
| WO | 9119573 | | 12/1991 |

* cited by examiner

*Primary Examiner* — Tuan N Nguyen

(74) *Attorney, Agent, or Firm* — Bachman & LaPointe, PC

(57) ABSTRACT

A fluid product, comprising a tank for storing the product in free form, a conveyor conduit projecting into the tank, an applicator device connected to the conveyor conduit, and a passage which has a first and a second mouth opening and in which a portion of the conveyor conduit is disposed, wherein the first mouth opening of the passage is disposed in the tank, the second mouth opening is connected to the interior of the tank only by way of the conveyor conduit, and the conveyor conduit projects out of the passage beyond the first mouth opening into the tank.

14 Claims, 2 Drawing Sheets

Fig. 1
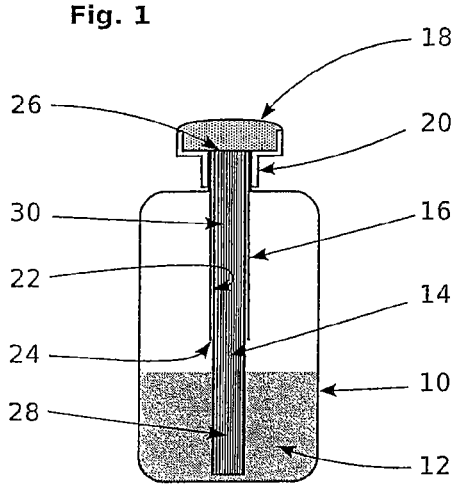
Fig. 2
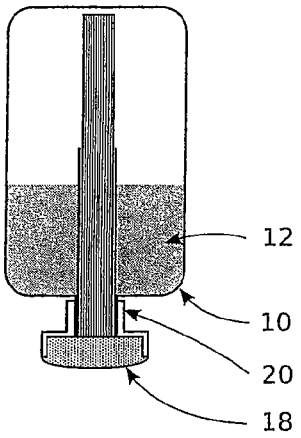
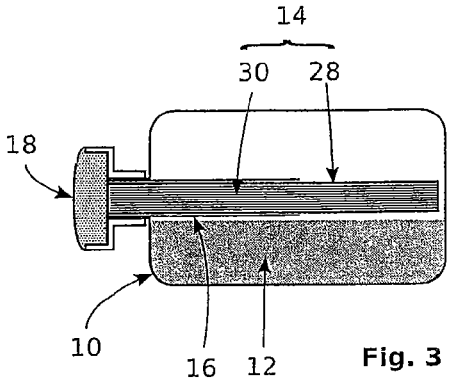
Fig. 3

DEVICE FOR STORING AND APPLYING A FLUID PRODUCT

BACKGROUND OF THE INVENTION

The invention concerns a device for storing and applying a fluid product, comprising a tank for storing the product in free form, a conveyor conduit projecting into the tank, an applicator device connected to the conveyor conduit, and a passage which has a first and a second mouth opening and in which a portion of the conveyor conduit is disposed, wherein the first mouth opening of the passage is disposed in the tank, the second mouth opening is connected to the interior of the tank only by way of the conveyor conduit, and the conveyor conduit projects out of the passage beyond the first mouth opening into the tank.

Applicator devices in the areas of writing, painting, drawing and marking, if they contain an application fluid, can be entirely roughly divided into two classes in terms of the storage capability. In the one class the application fluids are bound in capillary relationship in a storage device while in the other class the application fluid is freely movably accommodated in a hollow space. Systems of the latter kind are also known by the term 'free ink'. It is those systems that the present invention concerns.

In the case of free ink systems special precautions must be taken to effectively prevent the freely accommodated ink from escaping. By way of example valve systems, plate storage means and compensating systems with additional capillary storage means can be used for that purpose. Accidental escape of the application fluid can be caused for example by changes in pressure or temperature. The above-described known systems suffer from the disadvantage that additional measures usually have to be taken to achieve an anti-escape capability. In general those measures require additional components and therefore lead to complicated and expensive structures, whereby the manufacturing costs are increased.

Such measures are particularly problematical if there is to be a transition from relatively small volumes in respect of the application fluid (a few ml) to larger volumes. Here the reference to larger volumes is used to denote an amount which is markedly over 2 ml, that is to say for example 10 ml. For, the larger the freely accommodated volume to be stored is, the correspondingly greater must also be the buffer measures which are conventionally provided—such as for example capillary storage means—because the compensating volume required increases with the volume of the application fluid, when the application fluid is of the same composition and with the same changes in pressure and temperature.

A further problem of known applicator devices lies in the risk of the application fluid escaping even with constant boundary conditions (pressure and temperature), particularly in the case of markedly increased volumes of freely accommodated ink. In the case of known applicator devices, a reduced pressure occurs in the interior of the tank when the writing tip serving as the applicator device faces in the direction of the force of gravity, that is to say downwardly, and the conveyor conduit is in contact with the freely accommodated ink. That reduced pressure compensates for the hydrostatic pressure of the column of fluid. Therefore known devices do not suffer from escape just under normal conditions.

If now however the filling volume of free ink is increased, the hydrostatic pressure on the ink feed device is also increased, at least when the tank is increased in size not just in the radial direction but also in the axial direction, so that a greater reduced pressure is required to give the compensation effect.

The invention is based on a state of the art formed by a device of the kind set forth in the opening part of this specification. In the simplest case this involves a bottle, through which a conveyor conduit is passed into the interior of the bottle, that serves as the tank, wherein an applicator device is disposed at the other end of the conveyor conduit. The above-mentioned passage is formed in that case by the neck of the bottle. It does not usually gas-tightly surround the conveyor conduit.

The object of the invention is to develop the device of the above-indicated kind in such a way that it is more resistant to fluid discharge, more specifically even in the event of increases in pressure and/or temperature, while the complication and expenditure to provide the increased resistance to fluid discharge is to be minimal.

SUMMARY OF THE INVENTION

According to the invention the specified object is attained in that in any position of the device with respect to the direction of the force of gravity the volume of the tank that is beneath the first mouth opening is greater than a nominal filling volume of the device.

In other words the invention provides that, irrespective of how the device is held or put down, the product which is introduced into the tank never reaches the first mouth opening. That ensures that the product cannot be discharged through the first mouth opening. In comparison the only way out of the tank goes by way of the conveyor conduit (of a capillary nature). The conveyor conduit however is resistant to fluid escape because it only has contact with the fluid when the writing tip is above the level of fluid.

That resistance to fluid escape is achieved not just in relation to changes in pressure and/or temperature. Rather, the solution according to the invention provides that the pressure acting on the conveyor conduit when the writing tip is pointing in the direction of the force of gravity is markedly reduced because, due to the lack of contact with the ink, no hydrostatic pressure acts on the conveyor conduit. Accordingly, that provides in a simple manner for resistance to fluid discharge at constant boundary conditions (pressure and temperature) and with changing boundary conditions.

As the passage does not gas-tightly enclose the conveyor conduit and the mouth opening is in fluid communication with the product in no position of the device, there is always a communication between the gas space in the tank and the outside world so that increases in pressure can be compensated without any problems.

The structure according to the invention is particularly simple. Based on the bottle already described hereinbefore, the bottle neck has to be extended into the interior of the bottle, for example as far as the geometrical center of the tank volume. Compensating storage means or the like are in comparison not required.

Preferably in accordance with the invention there is at least one position of the device with respect to the direction of the force of gravity, in which the conveyor conduit is in conveyor communication with the product.

The device therefore only has to be moved into the specified position in order to convey the product through the conveyor conduit to the applicator device, which generally occurs automatically because of the capillarity of the conveyor conduit.

In accordance with a further preferred embodiment of the invention the conveyor conduit is flexible.

With this configuration it can bend for example under its own weight and can extend into the product even when it is not disposed as a prolongation of the longitudinal axis of the passage.

Preferably at least the free end of the portion of the conveyor conduit, that projects out of the passage, is of a lower density than the product.

That can provide that the free end floats on the product, which obviates the risk of the conveyor conduit being sucked fast against the tank wall.

Preferred in that respect is a float on the portion of the conveyor conduit, that projects out of the passage.

That configuration avoids modifying the conveyor conduit itself in order not to adversely affect the conveyor properties thereof.

In that case in accordance with the invention preferably the float is arranged at the free end of the portion of the conveyor conduit, that projects out of the passage.

More specifically the float has the greatest effect at the end of the conveyor conduit.

Preferably in accordance with the invention the passage is formed at least portion-wise by the interior of a tube.

That provides a particularly simple structure.

As a further measure against the conveyor conduit possibly being sucked fast against the wall of the tank, there can be provided a holder for holding at least a part of the portion of the conveyor conduit, that projects out of the passage.

In that case the holder serves to ensure a minimum spacing between the conveyor conduit on the one hand and the tank wall on the other hand.

The holder can have a tube.

That in turn affords a structurally particularly simple solution.

Preferred in accordance with the invention is a tube having two portions, of which a first portion at least partially forms the passage and a second portion belongs to a holder for holding the portion of the conveyor conduit, that projects out of the passage.

In other words this provides a solution in which both the passage and also the holder are formed by a tube. That is structurally once again particularly simple.

In that respect a further preferred feature according to the invention provides that the first mouth opening is formed by at least one through opening in the tube.

In other words, with that solution, a single tube is provided to form the passage and the holder, which tube can have at a suitable location, that is to say for example at the geometrical center of the tank volume, at least one through opening through which the gas exchange already referred to hereinbefore can take place upon an increase in pressure.

In a further preferred feature according to the invention the device has a bottom and automatically places itself on the bottom from any position on a flat horizontal surface.

In other words the device in accordance with this embodiment of the invention implements the principle of the automatically self-righting 'stand-up manikin'.

In accordance with a further preferred embodiment of the invention the device has a bottom which is on the side opposite to the applicator device, wherein the outside contour of the device and its mass distribution is such that it automatically places itself on the bottom from any position with respect to the direction of the force of gravity.

Once again therefore this implements the principle of the 'stand-up manikin'.

Finally it is particularly preferably provided according to the invention that the device according to the invention has a bottom which is on the side opposite to the applicator device and has a convex outside contour and in any position on a horizontal plane its center of gravity lies on the side of the bottom with respect to a vertical line through a contact point in the plane.

This solution also embodies the 'stand-up manikin' principle.

BRIEF DESCRIPTION OF THE DRAWINGS

The invention is described more fully in greater detail by means of preferred embodiments by way of example with reference to the accompanying drawing in which:

FIG. 1 shows a diagrammatic view in longitudinal section of a storage and applicator device in accordance with a preferred embodiment of the invention, FIG. 2 shows the device of FIG. 1, but in an upside down position, FIG. 3 shows the device of FIG. 1 but lying on its side.

DETAILED DESCRIPTION

Figure 5:
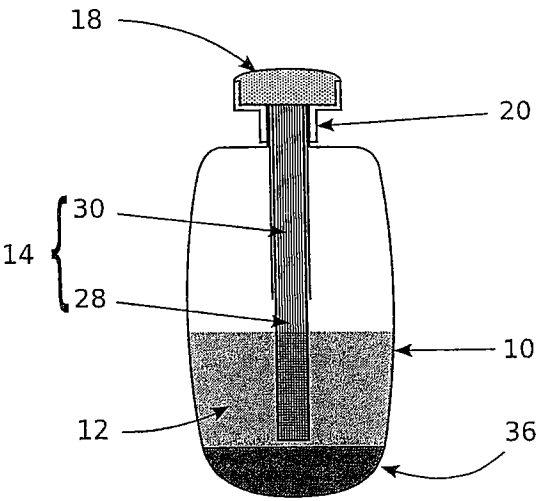
FIG. 5 shows the same view as FIG. 1 but of a further variant of the device.

The storage and applicator device shown in FIGS. 1 through 3 include a tank 10 in which a fluid product 12 is accommodated in free form, a conveyor conduit 14, a casing tube 16, an applicator tip 18 and a tip holder 20. The interior of the casing tube 16 forms a passage 22 for the conveyor conduit 14. It does not gas-tightly embrace the conveyor conduit. The conveyor conduit is of a capillary nature. In other words it conveys the fluid from the tank 10 to the applicator tip 18 by virtue of capillary effects.

A first mouth opening of the passage 22 is identified by reference 24, and a second mouth opening by reference 26. A portion 28 of the conveyor conduit 18 extends beyond the first mouth opening 24 out of the passage 22 into the fluid 12. Another portion 30 is within the passage 22.

The second mouth opening 26 is in communication with the interior of the tank 10 only by way of the passage 22 and the conveyor conduit 14 accommodated therein.

The first mouth opening 24 is at the geometrical center of the tank 10. The volume of the tank 10 is filled to less than half with the fluid 12. The fluid 12 therefore does not reach the first mouth opening 24 in any position of the device. The fluid 12 cannot therefore escape. Nonetheless there is the possibility of a pressure compensation effect, for example in the case of increases in pressure or temperature. More specifically, irrespective of the position of the device, there is always a communication between the gas space of the tank 10 and the second mouth opening 26 or the outside world, in particular because the casing tube 16 does not gas-tightly embrace the conveyor conduit 14. That is to be attributed to the fact that the first mouth opening 24 never projects into the fluid 12 and is therefore always open for gas exchange.

At this juncture it should be expressly pointed out that the amount of fluid 12 shown in FIGS. 1 through 3 corresponds to the nominal filling volume of the device. That nominal filling volume is less than half of the volume of the tank 10, that is available for accommodating the fluid 12.

It will be seen from the view in FIG. 3 that the conveyor conduit 14 is stiff in the illustrated embodiment. It can however also be flexible in nature. That would mean in the position shown in FIG. 3 that the conveyor conduit 14 bends under its own weight so that the portion 28 moves downwardly. So that that portion 28 is not sucked fast to the wall of the tank 10 a 'float' can be disposed at the free end of the portion 28. Such a float would be for example annular and would provide that the conveyor conduit cannot dip into the fluid 12 as far as the tank wall.

Figure 4:
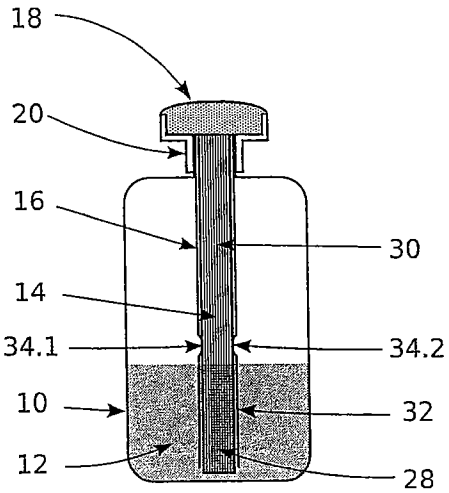
FIG. 4 shows the same view as FIG. 1 but of a variant of the device.

Another solution to the problem of being sucked fast to the tank wall is represented by the variant shown in FIG. 4. In accordance therewith the casing tube 16 is prolonged by a portion 32. The portion 32 serves in that case as a holder for the portion 28 of the conveyor conduit 14, that projects beyond the first mouth opening 24. In this case the mouth opening 24 is in the form of two through openings 34.1 and 34.2 in the casing tube which is prolonged by the portion 32. Alternatively it is also possible to use a correspondingly perforated, woven or sintered tube portion.

The configuration shown in FIG. 5 differs from that shown in FIGS. 1 through 3 only in that the tank 10 is of a bellied configuration, that is to say it is of a convex shape, and the bottom 36 is of a particularly heavy-mass nature. With that design configuration, the device always automatically sets itself on the bottom 36 again. That always ensures that fluid 12 further flows into the conveyor conduit 14.

The features of the invention disclosed in the foregoing description, the claims and the drawing can be essential both individually and also in any combinations for implementing the invention in its various embodiments.

The invention claimed is:

1. A device for storing and applying a fluid product, comprising a tank for storing the product in free form, a conveyor conduit projecting into the tank, an applicator device connected to the conveyor conduit, and a casing tube disposed around a portion of the conveyor conduit defines therebetween a passage which has a first and a second mouth opening and in which a portion of the conveyor conduit is disposed, wherein the first mouth opening of the passage is disposed in the tank, the second mouth opening is connected to the interior of the tank only by way of the conveyor conduit, and the conveyor conduit projects out of the passage beyond the first mouth opening into the tank, wherein in any position of the device with respect to the direction of the force of gravity the volume of the tank that is beneath the first mouth opening is greater than a nominal filling volume of the device, and wherein the casing tube forming said passage does not gas-tightly embrace said conveyor conduit.

2. A device as set forth in claim 1, wherein there is at least one position of the device with respect to the direction of the force of gravity, in which the conveyor conduit is in conveyor communication with the product.

3. A device as set forth in claim 1, wherein the conveyor conduit is flexible.

4. A device as set forth in claim 1, wherein at least a free end portion conveyor conduit projects out of the passage and is of a lower density than the product.

5. A device as set forth in claim 4, wherein a float on the portion of the conveyor conduit, that projects out of the passage.

6. A device as set forth in claim 5, wherein the float is arranged at the free end of the portion of the conveyor conduit, that projects out of the passage.

7. A device as set forth in claim 1, wherein the passage is formed at least portion-wise by an interior of a tube.

8. A device as set forth in claim 4, further comprising a holder for holding at least a part of the portion of the conveyor conduit, that projects out of the passage.

9. A device as set forth in claim 8, wherein the holder has a tube.

10. A device as set forth in claim 7, wherein the tube has two portions, a first portion at least partially forms the passage and a second portion belongs to a holder for holding the portion of the conveyor conduit, that projects out of the passage.

11. A device as set forth in claim 10, wherein the first mouth opening is formed by at least one through opening in the tube.

12. A device as set forth in claim 1, wherein the tank has a bottom and the tank automatically places itself on the bottom from any position on a flat horizontal surface.

13. A device as set forth in claim 12, wherein the bottom is on the side opposite to the applicator device, wherein the outside contour of the tank and its mass distribution is such that it automatically places itself on the bottom from any position with respect to the direction of the force of gravity.

14. A device as set forth in claim 12, wherein the bottom which is on the side opposite to the applicator device and has a convex outside contour and in any position on a horizontal plane its center of gravity lies on the side of the bottom with respect to a vertical line through a contact point in the plane.

* * * * *